US007891973B2

(12) United States Patent
Lenoir

(10) Patent No.: US 7,891,973 B2
(45) Date of Patent: Feb. 22, 2011

(54) APPLIANCE FOR CONNECTING A GAS-HEATED RADIANT ELEMENT

(75) Inventor: Patrick Lenoir, Villeneuve d'Ascq (FR)

(73) Assignees: NV Bekaert SA, Zwevegem (BE); Bekaert Combustion Technology B.V., Assen (NL)

( * ) Notice: Subject to any disclaimer, the term of this patent is extended or adjusted under 35 U.S.C. 154(b) by 243 days.

(21) Appl. No.: 10/591,536

(22) PCT Filed: Feb. 21, 2005

(86) PCT No.: PCT/EP2005/050733

§ 371 (c)(1),
(2), (4) Date: Nov. 13, 2006

(87) PCT Pub. No.: WO2005/085710

PCT Pub. Date: Sep. 15, 2005

(65) Prior Publication Data

US 2008/0160469 A1 Jul. 3, 2008

(30) Foreign Application Priority Data

Mar. 2, 2004 (FR) ..... 04 02141

(51) Int. Cl.
*F23Q 13/04* (2006.01)
*F26B 3/34* (2006.01)

(52) U.S. Cl. ..... 431/328; 431/326; 34/266; 34/267

(58) Field of Classification Search ..... 431/328, 431/329, 170, 354, 1, 7, 10, 326; 34/266, 34/267, 268; 285/231
See application file for complete search history.

(56) References Cited

U.S. PATENT DOCUMENTS

| | | | | |
|---|---|---|---|---|
| 3,021,893 | A * | 2/1962 | Honger | 431/329 |
| 3,407,023 | A | 10/1968 | Hirschberg, et al. | |
| 4,373,505 | A * | 2/1983 | Koziol | 126/39 E |
| 4,752,213 | A * | 6/1988 | Grochowski et al. | 431/328 |
| 4,762,530 | A * | 8/1988 | Koziol | 48/180.1 |
| 5,062,788 | A * | 11/1991 | Best | 431/7 |
| RE34,541 | E * | 2/1994 | Kreiger | 431/1 |
| 6,261,089 | B1 * | 7/2001 | Aldo | 431/354 |
| 6,665,950 | B1 * | 12/2003 | Riepe et al. | 34/266 |

FOREIGN PATENT DOCUMENTS

| | | | |
|---|---|---|---|
| EP | 0 223 691 | A1 | 5/1987 |
| JP | 59-024112 | A | 2/1984 |
| WO | WO 00/79045 | A1 | 12/2000 |

* cited by examiner

*Primary Examiner*—Kenneth B Rinehart
*Assistant Examiner*—Chuka C Ndubizu
(74) *Attorney, Agent, or Firm*—Foley & Lardner LLP

(57) ABSTRACT

An appliance for providing air and gas to a gas burner includes a gas tube and an air tube. The gas tube comprises an aperture for providing gas inwards to the air tube. The air tube comprises a first aperture for receiving a back tube of the gas burner. The gas tube is provided with a first part of a detachable connection device, for receiving a second part of the detachable connection device provided on the back tube for allowing gas from the gas tube to enter the back tube. The back tube has an orifice for allowing air from the air tube to enter inside the back tube.

34 Claims, 2 Drawing Sheets

APPLIANCE FOR CONNECTING A GAS-HEATED RADIANT ELEMENT

FIELD OF THE INVENTION

The present invention concerns an appliance for connecting a gas burner, preferably a gas-heated infrared radiant element to a fixed gas tube.

The present invention also concerns a gas burner such as a gas-heated infrared radiant element, adapted to be connected to a fixed gas tube by means of an appliance according to the present invention, as well as a system of gas burners, such as radiant elements, comprising at least one row of burners according to the present invention installed one next to the other in one direction, each burner being connected to a fixed corresponding gas pipe by means of an appliance according to the present invention.

BACKGROUND OF THE INVENTION

There exist many types of gas-heated infrared radiant elements in which the combustion of a mixture of combustible gas and air is used to heat a radiant element that radiates infrared radiation.

It is known to use systems of gas-heated radiant elements, consisting of at least one row of radiant elements installed one next to the other in a transversal direction in relation to a passing strip that has to be dried, such as e.g. a strip of paper that has just been coated at least on one side in order to produce coated paper, which strip is moved in front of the radiant elements.

The combustion air tubes and gas tubes, or the tubes for the mixture of combustion air and gas, are traditionally situated at the backside of the radiant elements of which the front side, that is the radiating side, is situated in front of the passing strip.

Traditionally, the fixed pipe to which a radiant element is fastened is a tube of a mixture of combustion air and gas, and this pipe is at the end equipped with a flange perforated with holes in which screws can be inserted.

Each radiant element is fastened in a traditional way by means of screws accessible at the back of the radiant element, the latter being extracted at the front when the drying installation comes to a standstill. The disassembly of a traditional radiant element thus makes it necessary to have access both from the front side and the backside to the system of radiant elements, which might necessitate the presence of two operators, one who unscrews the screws at the back, while the other takes out the radiant element at the front as soon as the screws are removed.

Such a replacement operation of a radiant element therefore is relatively long and expensive.

According to WO 00/79045 there exists an appliance for connecting a gas-heated infrared radiant element to a fixed gas tube connected to a gas tube, in which a combustion air tube is placed between the gas tube and the radiant element that holds on its back casing a back supply tube of a mixture of air and gas adapted to be connected to the fixed pipe and to be in communication with the air tube, and the appliance has detachable connection devices supported respectively, the first, by the back tube and the second, by the fixed pipe, and that are complementary to one another, and these detachable connection devices are arranged so as to be joined to one another or loosened from one another by one single person placed in front of the front side of the radiant element.

This appliance is interesting to the extent that the back tube of the represented radiant element is fastened by means that constitute a quick connect coupling to a support containing the gas tube.

U.S. Pat. No. 5,062,788, on which the preamble of claim 1 is based, describes an appliance for providing air and gas to a gas burner, which gas burner comprises a back tube for receiving air and gas to be combusted. The appliance comprises an air tube and a gas tube which gas tube comprising an aperture for providing gas inwards to the air tube. the air tube comprising a first aperture for receiving the back tubing, which first aperture of the gas tube and the first aperture of the air tube being aligned. The described assembly of air-gas appliance and burners are difficult do disassemble and may be difficult to work in modules. In order to maintain or repair defect elements of the burners, the whole appliance is to be disassembled which is extremely time consuming.

SUMMARY OF THE INVENTION

The present invention aims to provide an appliance of the aforementioned type that is simpler and more reliable than the one that is described.

Preferably, the aperture of the gas tube and the first aperture of the air tube are substantially aligned.

According to the present invention, the appliance of the aforementioned type is characterized by the fact that the first part of a detachable connection devices is supported by the aperture of the gas tube, to allow a second part of the detachable connection device, being supported by the back tube of a gas burner as subject of the present invention and which is adapted to communicate with the first part to pass through the first opening of the air tube.

A gas combustion device may comprise one of more appliances as subject of the present invention, each of them being provided to feed one or more, preferably aligned gas burners, with air and gas.

The back tube passes through the wall of the air tube through a first opening made in a first region of the said wall adjacent to the corresponding radiant element, and has an opening ending inside the air tube.

Such an appliance allows to keep free the space situated at the back of the radiant element, as the back tube of the radiant element is situated at the inside of the air tube.

In addition, the back tube is thus cooled down by the combustion air circulating in the air tube, and the same goes for the gas and combustion air mixture circulating in this back tubing. This is highly favourable to the working security of the whole installation.

According to an interesting version of the invention, the appliance has an organ that constitutes a gas injector that is connected to the back tubing. In that way, when a radiant element is disassembled, the gas injector and the gas supply opening are disassembled at the same time, allowing easy inspection and maintenance of both organs.

According to a preferential version of the invention, the fixed gas tube passes through the air tube wall through a second opening made in a second region of the said wall adjacent to the gas tube and opposite to the first region. When the appliance is assembled, the first and the second detachable connection devices are connected from the one to the other in the inside of the air tube, and these detachable connection devices together constitute a quick connect coupling.

Other particularities and advantages of the present invention will appear from the detailed description below.

BRIEF DESCRIPTION OF THE FIGURES

The invention will now be described into more detail with reference to the accompanying figures wherein.

DESCRIPTION OF THE PREFERRED EMBODIMENTS OF THE INVENTION

Figure 1:
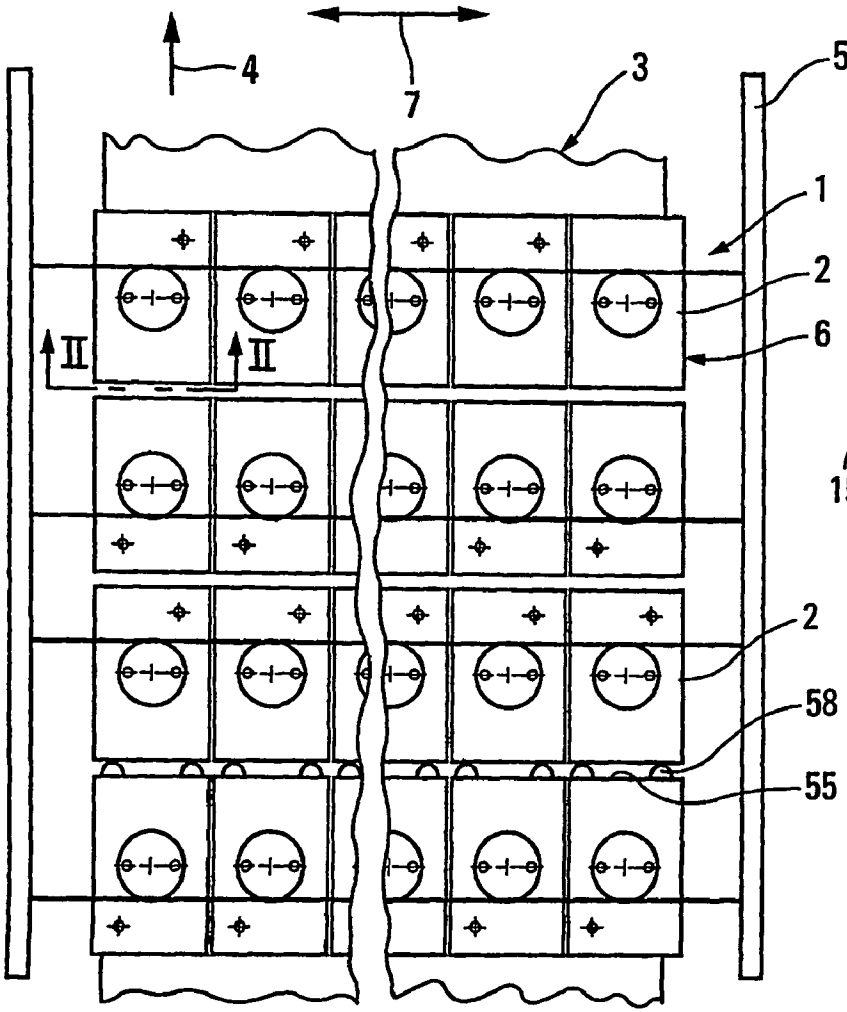
FIG. 1 is a schematic view of the backside of a gas combustion device, in this case comprising radiant elements, in which the air and gas tubes have been left out in order to make the figure clearer.

In FIG. 1, a schematic representation is given of the backside of a gas combustion device 1 as subject of the present invention, comprising gas burners 2, being radiant elements placed above a passing strip to be dried, represented in 3, that moves in the direction of the arrow 4.

The radiant elements 2 and the gas and combustion air tubes (not represented) are supported by a frame, schematised as 5.

The represented gas combustion device 1 has in this instance four rows 6 of radiant elements, one placed after the other in the direction of the arrow 4, and each row 6 has several radiant elements 2, in which one is placed next to the others, in the direction of the arrow 7 that is the transversal direction in relation to the strip 3 and that is perpendicular to the direction of the arrow 4.

The appliance meant by the present invention is an appliance 8 for connecting in a tight and detachable way, a gas burner such as a gas-heated infrared radiant element 2 via a fixed pipe 9 with a fixed aperture 9*a* connected to a gas tube 10, a combustion air tube 11 that is placed between the gas tube 10 and the radiant element 2. The radiant element 2 has on its back casing 12 a back tube 13 stretching out to the back from the casing 12 onwards and adapted to be connected via the fixed pipe 9 with the fixed aperture 9*a* to the gas tube 10.

The appliance 8 has detachable connection devices supported respectively, the first, mounted at the fixed pipe 9 with a fixed aperture 9*a* and the second, by the back tube 13, and they are complementary to one another.

These detachable connection devices are arranged so as to be able to be joined to one another or loosened from one another by one single person placed in front of the front side 14 of the radiant element 2, in which the front side 14 is the side of the radiant element adjacent to the strip 3 to be dried.

In that way, one single person placed in front of the front side 14 can disassemble a radiant element 2 and remove this radiant element 2 to the front, in the direction of the arrow 15 going from the radiant element 2 towards the strip 3.

The direction of the arrow 15 is also the direction of circulation of the air and gas mixture inside the back tube 13 towards the radiant element 2.

It should be said that the back tube 13 stretches out towards the back, in the direction of the arrow 16, from the radiant element 2 towards the aperture 9*a*.

According to the present invention, the back tube 13 passes through the wall 17 of the air tube 11 by a first opening 18 made in a first region 19 of the wall 17 adjacent to the corresponding radiant element 2.

The back tube 13 has an opening 20 ending inside 21 the air tube 11.

The air that penetrates through the opening 20 inside 13*a* of the back tube 13 mixes with the gas coming via the fixed pipe 9 with a fixed aperture 9*a* to form the mixture of gas and combustion air that supplies, in a classical way, the radiant element 2. Therefore, there is a connection to the air tube 11 without contact with the wall 17 of this tube.

The second detachable connection means supported by the back tube 13 obviously are adapted to pass through the first opening 18 of the wall 17 of the air tube 11, so as not to impede the removal of the radiant element 2 to the front in the direction of the arrow 15, or the insertion of a radiant element 2 in the direction of the arrow 16 towards the back.

Figure 2:
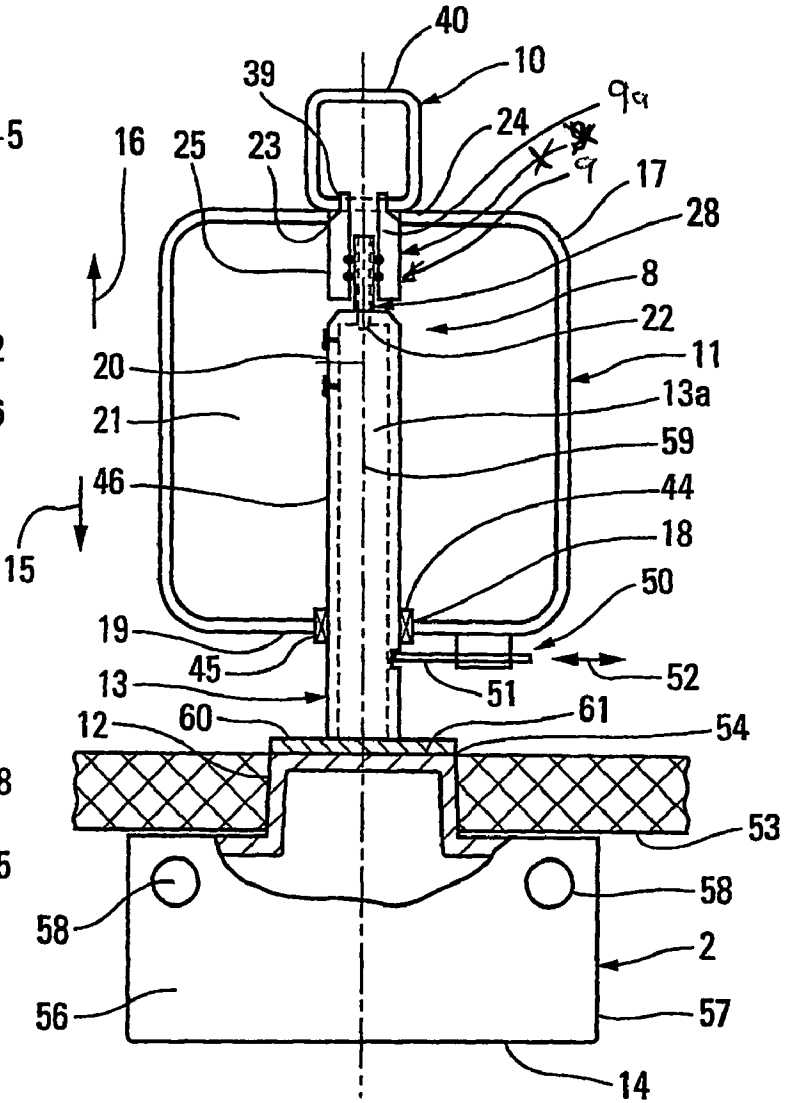
FIG. 2 is a schematic sectional view, according to II-II on FIG. 1, of a radiant element equipped with an appliance according to a realization method of the present invention.
Figure 4:
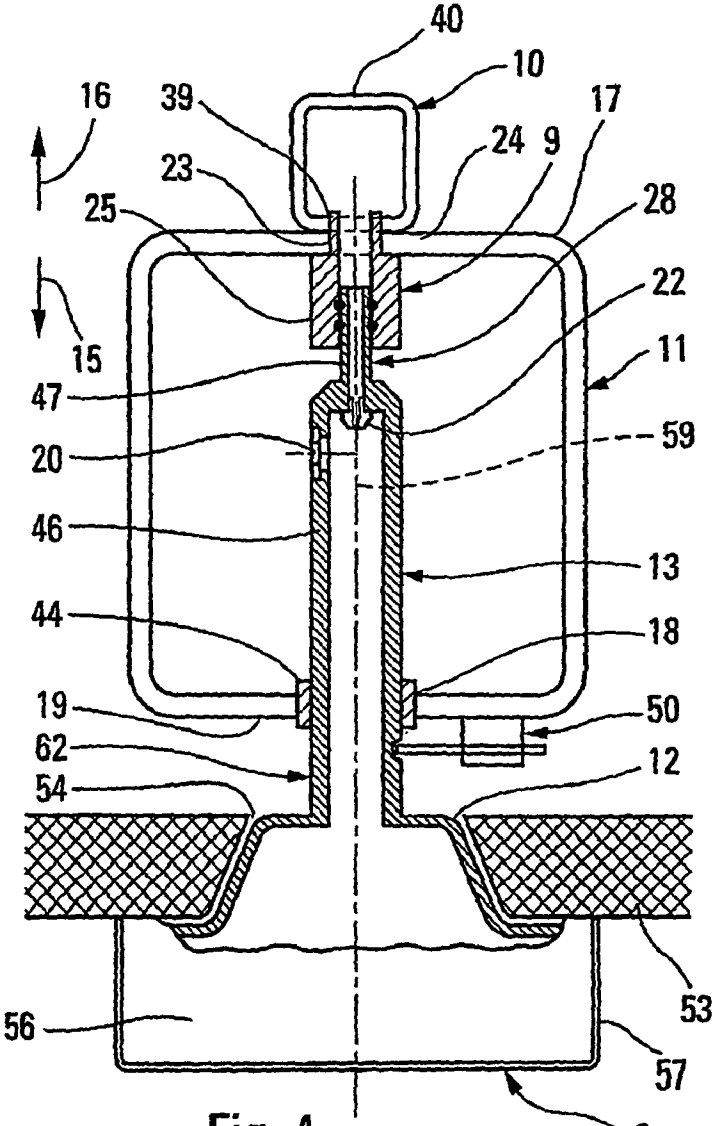
FIG. 4 is a view similar to FIG. 2, in which certain parts have been left out, representing another realization method of the present invention.
Figure 3:
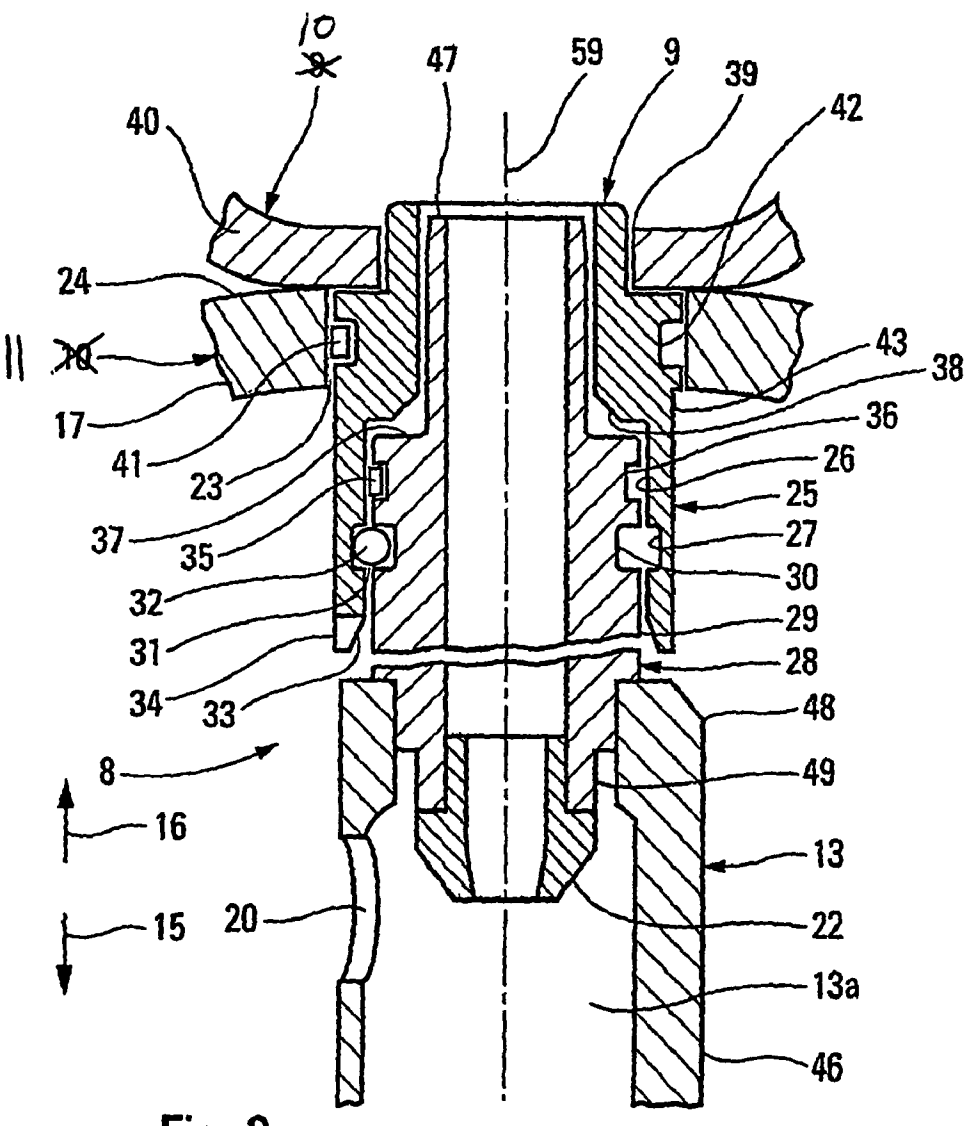
FIG. 3 is an enlarged view of a detail of FIG. 2.

In the example represented in FIGS. 2 to 4, the appliance 8 has a gas injector 22 that is connected to the back tube 13.

In that way, when the radiant element 2 is removed towards the front, in the direction of the arrow 15, one removes at the same time the back tube 13 with the gas injector 22 and the air supply opening 20, allowing easy inspection and maintenance of both organs.

In the same way, all detachable organs regulating and controlling the supply of both fluids, viz. the gas and the air, pass through the air tube 11 with the back tube 13.

In the represented realization method, the fixed pipe 9 passes through the wall 17 of the air tube 11 through a second opening 23 made in a second region 24 of the said wall 17 adjacent to the gas tube 10 and opposed to the first region 19.

Thus, the first and the second detachable connection devices are coupled to one another inside 21 the air tube 11.

This allows to easily realize an impenetrability, at least partial, between the edges of the second opening 23 and the external peripheral surface of the fixed pipe 9.

By way of variation, it could have been foreseen that the back tube 13 also passes through the second opening 23 in order to be connected to the gas tube via the fixed pipe 9 outside the air tube 11.

In an advantageous way, the first detachable connection devices and the second detachable connection devices together constitute a quick connect coupling of a type of the existing quick connect couplings that do not have to be described in detail hereinafter.

In the present example, the first detachable quick connect couplings and the second detachable quick connect couplings are conformed so that the ones constitute the female sleeve while the others constitute a male tubular organ adapted to be introduced in the female sleeve.

FIGS. 2 to 4 represent a preferential realization method of the fastening device according to the present invention.

The back tube 13 and the fixed pipe 9 are conformed so that the one, in the present instance a fixed pipe 9, constitutes a female sleeve 25 having on its internal peripheral surface 26 at least one annular groove 27, while the other, here the back tube 13, has a male tubular organ 28 adapted to be inserted inside the female sleeve 25.

The male tubular organ 28 has on its external peripheral surface 29 at least one annular groove 30. The annular grooves 27 and 30 are made in such way that, in the up position of the tubular organ 28 inside the sleeve 25, represented on the figures, the two annular grooves 27, 30 are clearly situated opposite of one another so as to constitute an annular aperture 31 in which an annular spring 32 can be inserted.

Conversely, the back tube 13 could be realized as a female sleeve and the fixed pipe 9 in the form of a male tubular organ.

The annular spring 32 imprisoned in the annular grooves 27 and 30 can be put under pressure by a forward traction in the direction of the arrow 15 so that it in an elastic way comes in the only annular groove 30 of the back tube 13 in order to allow the radiant element 2 to be removed to the front.

On the contrary, in order to fasten a radiant element 2 on the fixed pipe 9, the male tubular organ 28 with the annular spring 32 held by the annular groove 30 is inserted inside the female sleeve 25, in the direction of the arrow 16 towards the back.

The flattening 33 with truncated cone shape that widens towards the front, in the direction of the arrow 15, at the downstream end 34 of the female sleeve 25, obliges the annular spring 32, when the radiant element 2 is pushed towards the back in the direction of the arrow 16, to deform elastically so that it completely comes inside the groove 30 until the said groove 30 is situated opposite of the groove 27 of the sleeve 25 in order to allow the annular spring 32 to take its normal shape. This thus constitutes a detachable connection method, comparable to a quick connect coupling, of the radiant element 2 on the female sleeve 25 of the fixed pipe 9.

A sealing gasket 35 is, in a traditional way, inserted in a second annular groove 36 of the external peripheral surface 29 of the male tubular organ 28 of the back tube 13.

In order to accurately define the up position of the male tubular organ 28 inside the fixed pipe 9, this organ 28 presents a receding supporting face 37 that clearly hits a complementary protruding supporting face 38 of the fixed pipe 9.

The fixed pipe 9 is connected in a leak proof way, e.g. by screwing with addition of any known material guaranteeing a gastight connection, in a tapped hole 39 made in the wall 40 of the gas tube 10.

The tightness between the fixed pipe 9 and the edges of the second opening 23 of the air tube 11 is e.g. realized by means of an annular sealing gasket 41 put in an annular groove 42 made on the external peripheral surface 43 of the fixed pipe 9.

In order to simplify the installation of the radiant element 2, the passage of the back tube 13 through the first opening 18 in the first region 19 of the wall 17 of the air tube 11, is non-tight.

To that end, the back tube 13 has an external sleeve 44 that envelops the tube 13 and of which the external peripheral surface 45 is slightly tapered off towards the back in the direction of the arrow 16, to guide the passage of the back tube 13 in the first opening 18, and avoid inconvenient play.

The tightness between the external sleeve 44 and the edges of the first opening 18 is unnecessary to the extent that air leaks, if any and in any case weak leaks, do not present any inconvenience and on the contrary present the advantage of cooling down, if necessary, the region situated between the air tube 11 and the back body 12 of the radiant element 2.

On the figures, it can be seen that, in order to simplify manufacture and maintenance, the back tube 13 has a first piece of tube at the front 46, containing the air inlet opening 20 and a second piece of tube at the back 47, of which the inner diameter is slightly smaller than the inner diameter of the first piece 46 that is fastened e.g. by screwing to the back end 48 of the first piece 46, that penetrates the first piece 46 of the tube 13 and that constitutes the aforementioned male tubular organ 28.

The second piece of tube at the back 47 has at its front end 49 an organ 22 that functions as a gas injector to inject the gas in the interior volume 13*a* of the back tube 13.

Generally, the opening 20 is a calibrated opening that is made in a known way in order to simply and in an economical way, adjust the passage surface of the opening 20 in order to adapt it to the precise implantation and functioning conditions of each radiant element 2. In this way, the flow rate is regulated of the air that is necessary for a complete combustion of the gas that arrives at the corresponding radiant element 2.

In the realization method represented in FIG. 2, the back tube 13 has at its front end a flange, schematised as 60, fastened in a traditional way, e.g. by means of screws (not represented), on the backside 61 of the back body 12 of the radiant element 2.

In a more general way, the back tube 13 is adapted to be fastened to the back body 12 in any possible way.

In the example represented in FIG. 4, the back tube 13 forms one single piece with the back body 12 of the radiant element 2 in order to form a frame 62 on which, towards the front, the different organs, known as such, can be mounted to constitute a radiant element 2, and towards the back, the calibrated opening 20 and the piece of male tube 28 with the gas injector 22.

Other construction and assembly methods of the back tube 13 and the back body 12 of the radiant element 2 are obviously possible.

Locking devices 50 are foreseen to lock each radiant element 2 in its functioning position, to avoid all axial shifting and/or rotation of the radiant element 2.

These locking devices can consist of any known individual locking devices, each of them adapted to lock a respective radiant element, or any known general device for locking several radiant elements at the same time.

The locking devices 50 can e.g. consist of a sliding organ, represented in FIG. 2, under the form of a plate 51, sliding clearly parallel to the front face 14 of the radiant element 2 and the passing strip 3, as represented by the arrow 52.

The represented sliding organ 51 has for each radiant element any known locking devices adapted to mesh with the corresponding complementary devices of each of the radiant elements 2 (not represented), and is e.g. adapted to lock all radiant elements of the same row 6 or of the same gas combustion device 1 of radiant elements 2.

As the new disposition of the gas 10 and air tubes leaves much free space behind the radiant elements 2, and as it is no longer necessary to have access to those from the back, it is very easy and advantageous to foresee means, viz. thermal insulation panels 53, such as there are known, placed between the air tube 11 and each radiant element 2.

There can e.g. be a hole 54 perforated in the panels 53 for the passage of the back tube 13 of each radiant element 2. They contribute on the one hand to limit the thermal losses through the back and on the other hand, to separate a hot zone with the radiant elements 2 from a cold zone behind the panels 53, where more particularly the gas 10 and air 11 tubes, the connection devices 8 and the frame 5 (see FIG. 2) are situated.

Finally, as represented in FIGS. 1 and 2, each radiant element 2 can advantageously have on at least one of its lateral edges 55, or on at least one of the lateral edges 56 of a peripheral jacket 57 enveloping the said radiant element 2 and stretching out to panels 53, devices that constitute ridges 58 of any appropriate shape protruding towards the exterior in relation to the corresponding lateral edge 55, 56. These devices that constitute ridges 58 are adapted to come clearly in contact with an adjacent lateral edge 55, 56 of an adjacent radiant element 2 in order to align or centre each radiant element 2 in relation to each adjacent radiant element in the same row 6 or in the same gas combustion device 1. Indeed, the fastening device 8 described above, regardless of the variation taken into account, in principle does not have any means that blocks the pivot motion of a radiant element 2 along the axis 59, mainly for economizing on the cost price, to the exception, if the occasion arises, of locking devices, such as the devices 50.

Device 8 described in FIGS. 2 to 4 thus allows, not only to quickly assemble or disassemble, in a simple and reliable way, a radiant element 2 on the fixed pipe 9, but also allows new highly interesting arrangements in the back part of the radiant elements, as for the gas 10 and the air 11 tubes and the installation of thermal insulation panels 53.

More particularly, it is possible to disassemble, together with each of the radiant elements 2, the delicate parts that constitute the gas injector 22 and the air inlet opening 20 for inspection and maintenance.

It guarantees a detachable and tight connection to the gas tube 10 and a calibrated air supply without contact with the wall 17 of the air tube 11.

Indeed, the present invention is not limited to the realization methods described above and many changes can be made without leaving the scope of the invention.

In that way, the particularities of the above-described invention can be combined in any possible way amongst themselves and/or in combination with known particularities.

It is also possible to replace the afore-described detachable connection means with equivalent means, e.g. by means that are adapted to cooperate together and with devices that constitute appropriate springs, so as to oppose a predetermined maximum resistance and to yield in a reproducible way to a load force that exceeds this maximal resistance, both for the assembly as well as for the disassembly of the said radiant element 2.

It can e.g. be foreseen to make at least one radial groove in the female sleeve, which groove holds a ball that is constantly attracted towards the interior by a spring, and in which the ball can be put in a clearly hemispherical excavation in the male element and from which it can be removed.

It is also possible to use a bayonet-fastening device with compression of an elastic sealing gasket.

The invention claimed is:

1. An appliance for providing air and gas to a gas burner having a back tube for receiving air and gas to be combusted, comprising:

an air tube comprising opposing first and second wall regions connected by longitudinal wall regions such that an inside space is enclosed by the first, second, and longitudinal wall regions; and a gas tube comprising an aperture for providing gas inwards to the air tube, wherein the air tube comprises a first aperture at the first wall region for receiving the back tube of the gas burner such that the back tube extends through the first aperture from outside the first wall region into the inside space, and wherein the aperture of the gas tube is provided with a first part of a detachable connection device, for receiving a second part of the detachable connection device provided on the back tube for allowing gas from the gas tube to enter the back tube.

2. The appliance as claimed in claim 1, wherein the aperture of the gas tube and the first aperture of the air tube are substantially aligned.

3. The appliance as claimed in claim 1, wherein the detachable connection device is a quick connect coupling.

4. The appliance as claimed in claim 3, wherein the first part of the quick connect coupling constitutes a male tubular organ for being received by a female sleeve from the second part of the quick connect coupling.

5. The appliance as claimed in claim 4, wherein the male tubular organ has on its external peripheral surface at least one annular groove opened outward, the groove being adapted to receive an annular spring.

6. The appliance as claimed in claim 3, wherein the first part of the quick connect coupling constitutes a female sleeve for receiving a male tubular organ from the second part of the quick connect coupling.

7. The appliance as claimed in claim 6, wherein the female sleeve has in its internal peripheral surface at least one annular groove opened towards its interior, and wherein the groove is adapted to receive an annular spring.

8. The appliance as claimed in claim 1, wherein the gas tube is located outside and adjacent to the air tube, wherein the air tube comprises a second aperture at the second wall region for communicating with the aperture of the gas tube, and wherein the first part of the detachable connection device extends to the inside space of the air tube.

9. The appliance as claimed in claim 1, wherein the first part of the detachable connection device is provided with at least one sealing gasket for providing a gas-tight coupling between the first part and the second part of the detachable connection device.

10. A gas burner for receiving air and gas to be combusted from an appliance, the appliance comprising an air tube and a gas tube comprising an aperture for providing gas inwards to the air tube, the gas burner comprising:

a radiant panel; and a back tube for providing air and gas to the radiant panel, wherein the back tube has an orifice for allowing air from the air tube to enter inside the back tube, wherein the air tube comprises opposing first and second wall regions connected by longitudinal wall regions such that an inside space is enclosed by the first, second, and longitudinal wall regions, and a first aperture at the first wall region for receiving the back tube such that the back tube extends through the first aperture from outside the first wall region into the inside space, and wherein the back tube is provided with a second part of a detachable connection device for receiving a first part of the detachable connection device present at the aperture of the gas tube.

11. The gas burner as claimed in claim 10, wherein the second part of the detachable connection device is adapted to pass through the first aperture of the air tube.

12. The gas burner as claimed in claim 10, wherein the detachable connection device is a quick connect coupling.

13. The gas burner as claimed in claim 12, wherein the second part of the quick connect coupling constitutes a male tubular organ for being received by a female sleeve of the first part of the quick connect coupling.

14. The gas burner as claimed in claim 13, wherein the male tubular organ has on its external peripheral surface at least one annular groove opened towards its exterior, and wherein the groove is adapted to receive an annular spring.

15. The gas burner as claimed in claim 12, wherein the back tube has at its back end a male tubular organ, wherein the male tubular organ comprises a piece of tube penetrating in the back end of the back tube, and wherein the piece of tube constitutes an injector for injecting gas into the back tube.

16. The gas burner as claimed in claim 15, wherein the orifice is provided at a level of the injector.

17. The gas burner as claimed in claim 12, wherein the second part of the quick connect coupling constitutes a female sleeve for receiving a male tubular organ from the first part of the quick connect coupling.

18. The gas burner as claimed in claim 17, wherein the female sleeve has in its internal peripheral surface at least one annular groove opened towards its interior, and wherein the groove is adapted to receive an annular spring.

19. The gas burner as claimed in claim 10, wherein the second part of the detachable connection device is provided with at least one sealing gasket for providing a gas-tight coupling between the first and second parts of the detachable connection device.

20. The gas burner as claimed in claim 10, wherein the gas burner is an infrared radiant element.

21. A gas combustion device comprising:

at least one gas burner comprising a radiant panel, and a back tube for receiving air and gas to be combusted and for providing air and gas to the radiant panel; and an appliance for providing air and gas to the gas burner, wherein the appliance comprises an air tube and a gas tube, wherein the gas tube comprises an aperture for providing gas inwards to the air tube, wherein the air tube comprises opposing first and second wall regions connected by longitudinal wall regions such that an inside space is enclosed by the first, second, and longitudinal wall regions, and a first aperture at the first wall region for receiving the back tube such that the back tube extends through the first aperture from outside the first wall region into the inside space, wherein the back tube has an orifice for allowing air from the air tube to enter inside the back tube, and wherein the aperture of the gas tube is provided with a first part of a detachable connection device, for receiving a second part of the detachable connection device provided on the back tube for allowing gas from the gas tube to enter the back tube.

22. The gas combustion device as claimed in claim 21, wherein the aperture of the gas tube and the first aperture of the air tube are substantially aligned.

23. The gas combustion device as claimed in claim 21, wherein the detachable connection device is a quick connect coupling.

24. The gas combustion device as claimed in claim 23, wherein one of the first and second parts of the quick connect coupling constitutes a male tubular organ, wherein the other of the first and second parts of the quick connect coupling constitutes a female sleeve, and wherein the male tubular organ is adapted for being received by the female sleeve.

25. The gas combustion device as claimed in claim 24, wherein the male tubular organ has on its external peripheral surface at least one annular groove opened towards its exterior, and wherein the groove is adapted to receive an annular spring.

26. The gas combustion device as claimed in claim 24, wherein the female sleeve has in its internal peripheral surface at least one annular groove opened towards its interior, and wherein the groove is adapted to receive an annular spring.

27. The gas combustion device as claimed in claim 26, wherein the male tubular organ has on its external peripheral surface at least one annular groove opened towards its exterior, and wherein the gas burner further comprises the annular spring being received in the annular grooves of the male tubular organ and the female sleeve.

28. The gas combustion device as claimed in claim 23, wherein the second part of the quick connect coupling constitutes a male tubular organ.

29. The gas combustion device as claimed in claim 23, wherein the back tube has at its back end a male tubular organ, wherein the male tubular organ comprises a piece of tube penetrating in the back end of the back tube, and wherein the piece of tube constitutes an injector for injecting gas into the back tube.

30. The gas combustion device as claimed in claim 29, wherein the orifice is provided at a level of the injector.

31. The gas combustion device as claimed in claim 21, wherein the gas tube is located outside and adjacent to the air tube, wherein the air tube comprises a second aperture at the second wall region for communicating with the aperture of the gas tube, and wherein the first part of the detachable connection device extends to the inside space of the air tube.

32. The gas combustion device as claimed in claim 21, wherein the first part and/or the second part of the detachable connection device is provided with at least one sealing gasket for providing a gas-tight coupling between the first and second parts of the detachable connection device.

33. The gas combustion device as claimed in claim 21, wherein the second part of the detachable connection device is adapted to pass through the first aperture of the air tube.

34. The gas combustion device as claimed in claim 21, wherein the gas burner is an infrared radiant element.

* * * * *